US011568846B2

(12) United States Patent
Logan et al.

(10) Patent No.: US 11,568,846 B2
(45) Date of Patent: Jan. 31, 2023

(54) ACOUSTIC METAMATERIAL STRUCTURES AND GEOMETRY FOR SOUND AMPLIFICATION AND/OR CANCELLATION

(71) Applicant: Jabil Inc., St. Petersburg, FL (US)

(72) Inventors: David Donald Logan, St. Petersburg, FL (US); Katelyn Christensen, St. Petersburg, FL (US); Andrew Thomas Ferguson, San Jose, CA (US); Arthur Ray Junior Cruz Paquia, San Jose, CA (US); Calvin Saechao, San Jose, CA (US)

(73) Assignee: Jabil Inc., St. Petersburg, FL (US)

( * ) Notice: Subject to any disclaimer, the term of this patent is extended or adjusted under 35 U.S.C. 154(b) by 560 days.

(21) Appl. No.: 16/587,263

(22) Filed: Sep. 30, 2019

(65) Prior Publication Data

US 2021/0097967 A1 Apr. 1, 2021

(51) Int. Cl.
*G10K 11/162* (2006.01)
*G10K 11/08* (2006.01)

(52) U.S. Cl.
CPC ..... *G10K 11/162* (2013.01); *G10K 11/08* (2013.01)

(58) Field of Classification Search
CPC ..... G10K 11/162; G10K 11/08
USPC ..... 181/286
See application file for complete search history.

(56) References Cited

U.S. PATENT DOCUMENTS

| | | | | |
|---|---|---|---|---|
| 9,437,184 | B1 * | 9/2016 | Swett | G10K 11/30 |
| 2007/0188385 | A1 | 8/2007 | Hyde et al. | |
| 2009/0139762 | A1 | 6/2009 | Kessler | |
| 2011/0317275 | A1 | 12/2011 | Smith et al. | |

(Continued)

FOREIGN PATENT DOCUMENTS

| | | | |
|---|---|---|---|
| CN | 106448650 | A | 2/2017 |
| WO | 2018029460 | A1 | 2/2018 |
| WO | 2018146489 | A1 | 8/2018 |

OTHER PUBLICATIONS

Fok, Lee Ren, "Anisotropic and Negative Acoustic Index Metamaterials", UC Berkeley Electronic Theses and Dissertations, 2010.

(Continued)

*Primary Examiner* — Forrest M Phillips
(74) *Attorney, Agent, or Firm* — Young Basile Hanlon & MacFarlane, P.C.

(57) ABSTRACT

Disclosed herein are implementations of acoustic metamaterial structures and geometric configurations of acoustic metamaterial structures which produce sound amplification or cancellation. An acoustic metamaterial device for using with a sound source includes a plurality of fins, where each fin is made from a very dense material with respect to air which creates the anisotropic properties of the acoustic metamaterial device, where each fin has a length dimension, a width dimension, and a thickness dimension, the width and length dimension being equal and substantially perpendicular to the direction of sound wave propagation from the sound source, where each fin is sized different from other fins along the width and length dimension, and where the plurality of fins are interconnected such that planes formed by the width and length dimension of each fin faces perpendicular to the sound wave propagation direction from the sound source.

20 Claims, 19 Drawing Sheets
(11 of 19 Drawing Sheet(s) Filed in Color)

(56) References Cited

U.S. PATENT DOCUMENTS

| | | | | |
|---|---|---|---|---|
| 2013/0100233 | A1* | 4/2013 | Turqueti | H04R 1/342 381/345 |
| 2014/0182966 | A1 | 7/2014 | Fisk et al. | |
| 2015/0279345 | A1 | 10/2015 | Mathur | |
| 2018/0047259 | A1* | 2/2018 | Carter | G10K 11/1785 |
| 2018/0286379 | A1* | 10/2018 | Norris | G10K 11/30 |
| 2020/0284529 | A1* | 9/2020 | Lee | F01N 1/023 |

OTHER PUBLICATIONS

Memoli et al., "Vari-Sound A Varifocal Lens for Sound", CCS '18: Proceedings of the 2018 ACM SIGSAC Conference on Computer and Communications Security, ACM Press, New York, New York, USA, May 2, 2019 (May 2, 2019), pp. 1-14, XP058635211, DOI: 10.1145/3290605.3300713, ISBN: 978-1-4503-6201-6.

European Search Report in corresponding European Patent Application EP20873160.4, dated Sep. 28, 2022, 10 pgs.

* cited by examiner

ACOUSTIC METAMATERIAL STRUCTURES AND GEOMETRY FOR SOUND AMPLIFICATION AND/OR CANCELLATION

TECHNICAL FIELD

This disclosure relates to acoustic metamaterial structures and geometric configurations of the acoustic metamaterial structures which produce sound amplification and/or cancellation.

BACKGROUND

Acoustic metamaterials are artificially fabricated materials designed to manipulate sound wave propagation resulting in acoustic transformation behaviors that are not normally observed in natural materials. For example, a technology demonstrator called an acoustic hyperlens, constructed using acoustic metamaterials, can transform near field waves into far field waves. The acoustic hyperlens propagates sound waves along air gaps between radial fins made of very dense material such as brass.

SUMMARY

Disclosed herein are implementations of acoustic metamaterial structures and geometric configurations of acoustic metamaterial structures which produce sound amplification or cancellation. In an implementation, an acoustic metamaterial device for using with a sound source includes a plurality of fins, where each fin is made from a very dense material with respect to air which creates the anisotropic properties of the acoustic metamaterial device, where each fin has a length dimension, a width dimension, and a thickness dimension, the width and length dimension being equal and substantially perpendicular to the direction of sound wave propagation from the sound source, where each fin is sized different from other fins along the width and length dimension, and where the plurality of fins are interconnected such that planes formed by the width and length dimension of each fin faces perpendicular to the sound wave propagation direction from the sound source.

In an implementation, a noise cancellation device includes a plurality of fin sections, each fin section including a plurality of fins, where each fin is made from a very dense material with respect to air which creates the anisotropic properties of the acoustic metamaterial device, where each fin has a first dimension, a second dimension, and a third dimension, where two of the first dimension, second dimension, and the third dimension being equal and substantially perpendicular to a sound wave propagation direction from a sound source, where each fin is sized different along the two equal dimensions, where the plurality of fins are interconnected such that planes formed by the equal two dimensions of each fin is perpendicular to the sound wave propagation direction from the sound source, and where the plurality of fin sections substantially enclose the sound source.

BRIEF DESCRIPTION OF THE DRAWINGS

The patent or application file contains at least one drawing executed in color. Copies of this patent or patent application publication with color drawings will be provided by the Office upon request and payment of the necessary fee.

The disclosure is best understood from the following detailed description when read in conjunction with the accompanying drawings and are incorporated into and thus constitute a part of this specification. It is emphasized that, according to common practice, the various features of the drawings are not to-scale. On the contrary, the dimensions of the various features are arbitrarily expanded or reduced for clarity.

DETAILED DESCRIPTION

Figure 1:
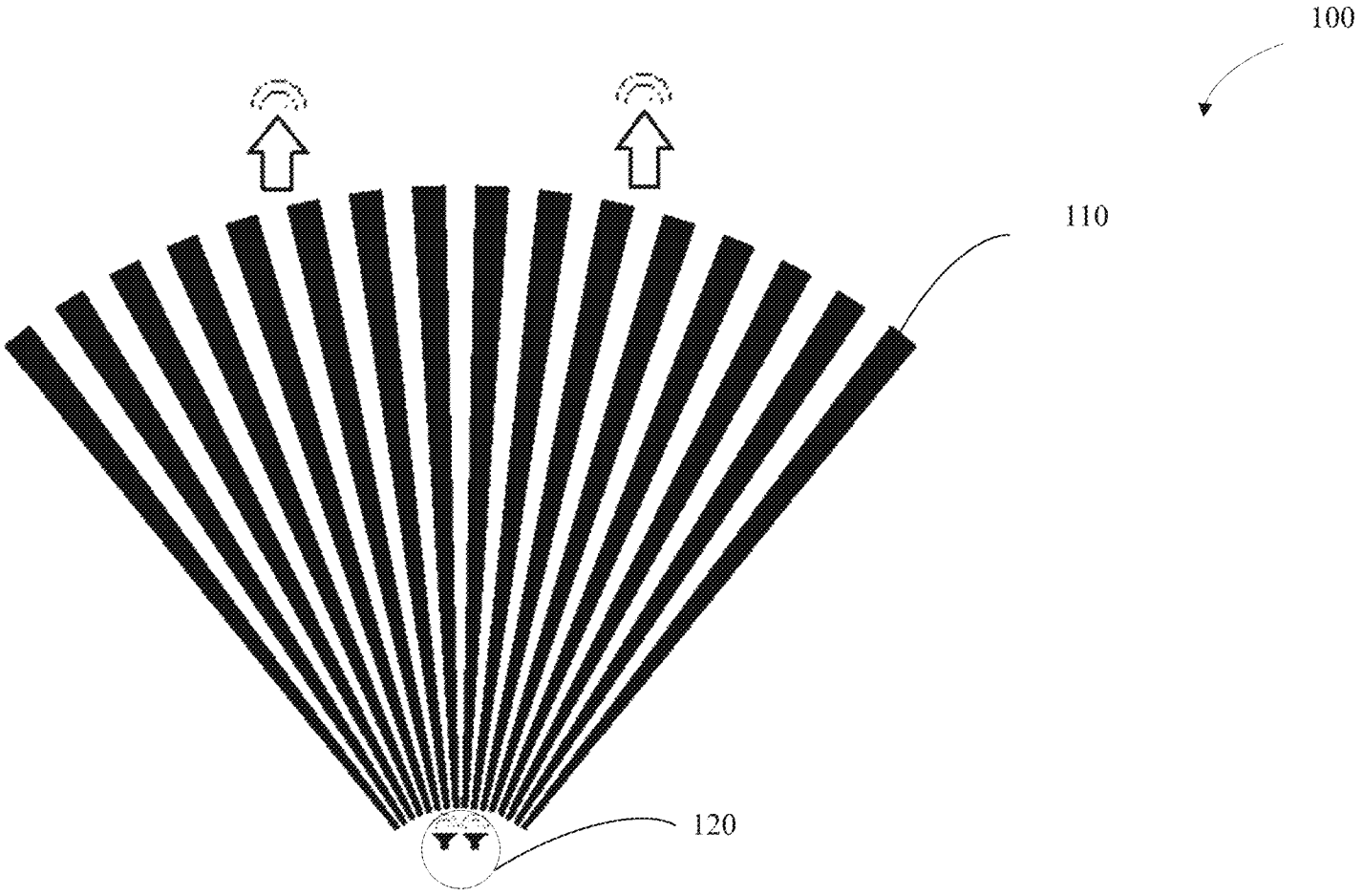
FIG. 1 is a diagram of an acoustic hyperlens and a dual speaker sound source.

The figures and descriptions provided herein may be simplified to illustrate aspects of the described embodiments that are relevant for a clear understanding of the herein disclosed processes, machines, manufactures, and/or compositions of matter, while eliminating for the purpose of clarity other aspects that may be found in typical similar devices, systems, compositions and methods. Those of ordinary skill may thus recognize that other elements and/or steps may be desirable or necessary to implement the devices, systems, compositions and methods described herein. However, because such elements and steps are well known in the art, and because they do not facilitate a better understanding of the disclosed embodiments, a discussion of such elements and steps may not be provided herein. However, the present disclosure is deemed to inherently include all such elements, variations, and modifications to the described aspects that would be known to those of ordinary skill in the pertinent art in light of the discussion herein.

Embodiments are provided throughout so that this disclosure is sufficiently thorough and fully conveys the scope of the disclosed embodiments to those who are skilled in the art. Numerous specific details are set forth, such as examples of specific aspects, devices, and methods, to provide a thorough understanding of embodiments of the present disclosure. Nevertheless, it will be apparent to those skilled in the art that certain specific disclosed details need not be employed, and that embodiments may be embodied in different forms. As such, the exemplary embodiments set forth should not be construed to limit the scope of the disclosure.

The terminology used herein is for the purpose of describing particular embodiments only and is not intended to be limiting. For example, as used herein, the singular forms "a", "an" and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof.

The steps, processes, and operations described herein are thus not to be construed as necessarily requiring their respective performance in the particular order discussed or illustrated, unless specifically identified as a preferred or required order of performance. It is also to be understood that additional or alternative steps may be employed, in place of or in conjunction with the disclosed aspects.

Yet further, although the terms first, second, third, etc. may be used herein to describe various elements, steps or aspects, these elements, steps or aspects should not be limited by these terms. These terms may be only used to distinguish one element or aspect from another. Thus, terms such as "first," "second," and other numerical terms when used herein do not imply a sequence or order unless clearly indicated by the context. Thus, a first element, step, component, region, layer or section discussed below could be termed a second element, step, component, region, layer or section without departing from the teachings of the disclosure.

The non-limiting embodiments described herein are with respect to structures and devices and methods for making the structures and devices, where the structures and devices are acoustic metamaterial structures and geometric configurations of the acoustic metamaterial structures which produce sound amplification and/or cancellation. The structures and devices and methods for making the structures and devices may be modified for a variety of applications and uses while remaining within the spirit and scope of the claims. The embodiments and variations described herein, and/or shown in the drawings, are presented by way of example only and are not limiting as to the scope and spirit. The descriptions herein may be applicable to all embodiments of the device and the methods for making the devices.

Disclosed herein are implementations of acoustic metamaterial structures and geometric configurations of the acoustic metamaterial structures which produce sound amplification and/or cancellation and methods for making the acoustic metamaterial structures.

Acoustic metamaterials are artificially fabricated materials designed to manipulate sound wave propagation resulting in acoustic transformation behaviors that are not normally observed in natural materials. This manipulation of sound wave propagation leads to unique acoustic transformations and potential real-world applications. When a propagating sound wave at a certain frequency encounters a structural object in its path, the propagation behavior changes due to the geometry and material properties of the object. These changes in wave propagation are the result of diffraction around the object, refraction thru the object, and reflection away from the object. In regard to acoustic metamaterials, these structural objects are periodic unit cells embedded within the material itself and as a result characterize the overall properties of the material using an effective parameters approach. This approach avoids the complexity of sound wave interaction at each individual periodic cell. Therefore, an acoustic metamaterial exploits its own inherent periodic cell structure to manipulate the effective material properties such as mass density and bulk modulus. In turn, these effective properties influence the material's anisotropy and index of refraction resulting in unique and predictable sound wave propagation. In general, objects made from acoustic metamaterials use periodic structured cells to manipulate the object's effective mass density and bulk modulus which determines the material's properties, such as anisotropy and index of refraction, to create unique acoustic transformation functions.

Figure 2:
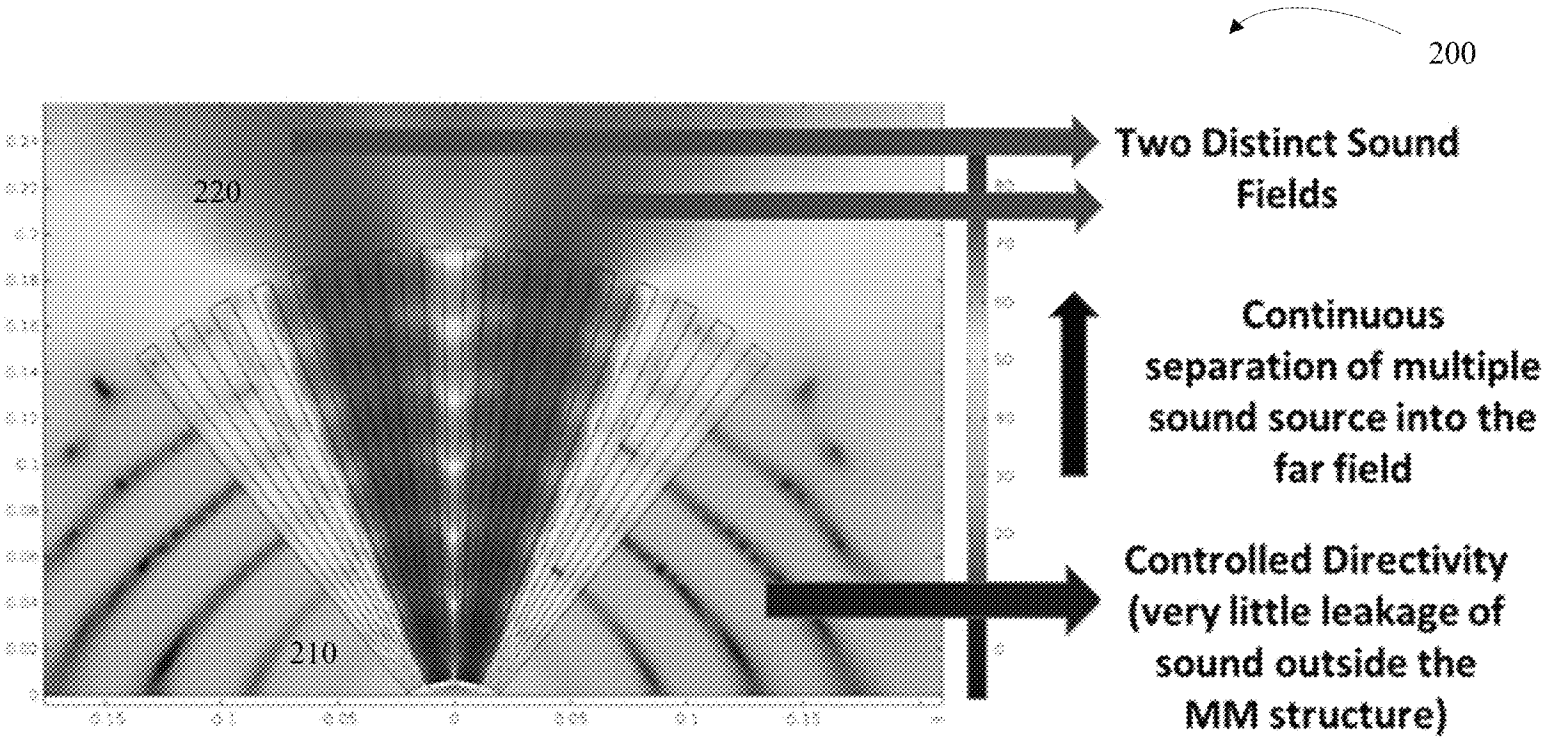
FIG. 2 is a simulated sound field or pattern of the acoustic hyperlens of FIG. 1.

FIG. 1 is a diagram of an acoustic hyperlens 100 and FIG. 2 is a sound field or pattern 200 of the acoustic hyperlens 100 of FIG. 1. The acoustic hyperlens 100 is a metamaterial that can transform near field waves into far field waves. The inherent anisotropic properties of this metamaterial facilitates the transformation. As shown, the acoustic hyperlens 100 includes a number of fins 110 that radiate from or with respect to a dual speaker sound source 120. The fins 110 may be made of very dense materials such as for example, but not limited to, brass which creates the anisotropic properties of the acoustic hyperlens. The acoustic hyperlens 100 has a geometric configuration where the sound waves are propagated along air gaps between the fins 100. FIG. 2 is a simulated sound field or pattern of the acoustic hyperlens of FIG. 1. As shown in FIG. 2, the acoustic hyperlens 100 allows two distinct sound fields, located in the near field 210, to propagate as individual sound sources into the far field 220 by having controlled directivity and continuous separation of multiple sound sources.

Figure 3:
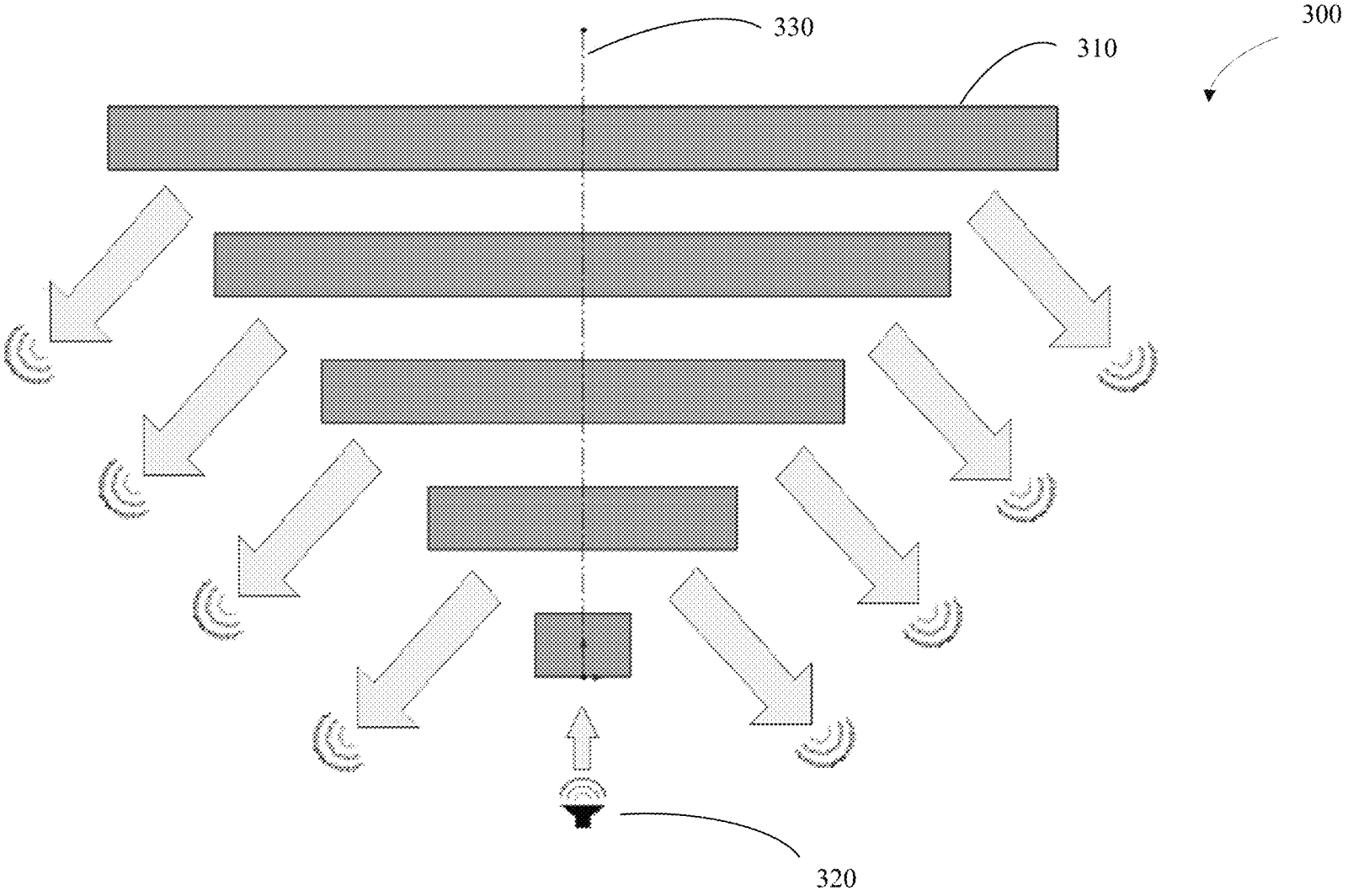
FIG. 3 is an example acoustic metamaterial fin structure having a fin geometry perpendicular to a sound source in accordance with certain implementations.

FIG. 3 is a 2D diagram of an example acoustic metamaterial fin structure 300 having a fin geometry perpendicular to a sound source 320 in accordance with certain. The acoustic metamaterial fin structure 300 includes a plurality of fins 310 which are oriented perpendicular to a single sound source 320. In an implementation, the fins 310 are made from a very dense material with respect to the density of air, including but not limited to, brass which facilitates the structure's anisotropic properties by manipulating the bulk modulus and/or mass density in different directions through the structure. Each of the fins 310 is wider (or longer) in the perpendicular direction with respect to the sound source 320 and each fin 310 is symmetric about a line 330 drawn from the sound source 320. The fin spacing, fin width, fin thickness and number of fins 310 may depend on the frequency of interest, wavelength of interest, and the like. In an implementation, an air layer is between each of the fins 310.

Figure 4:
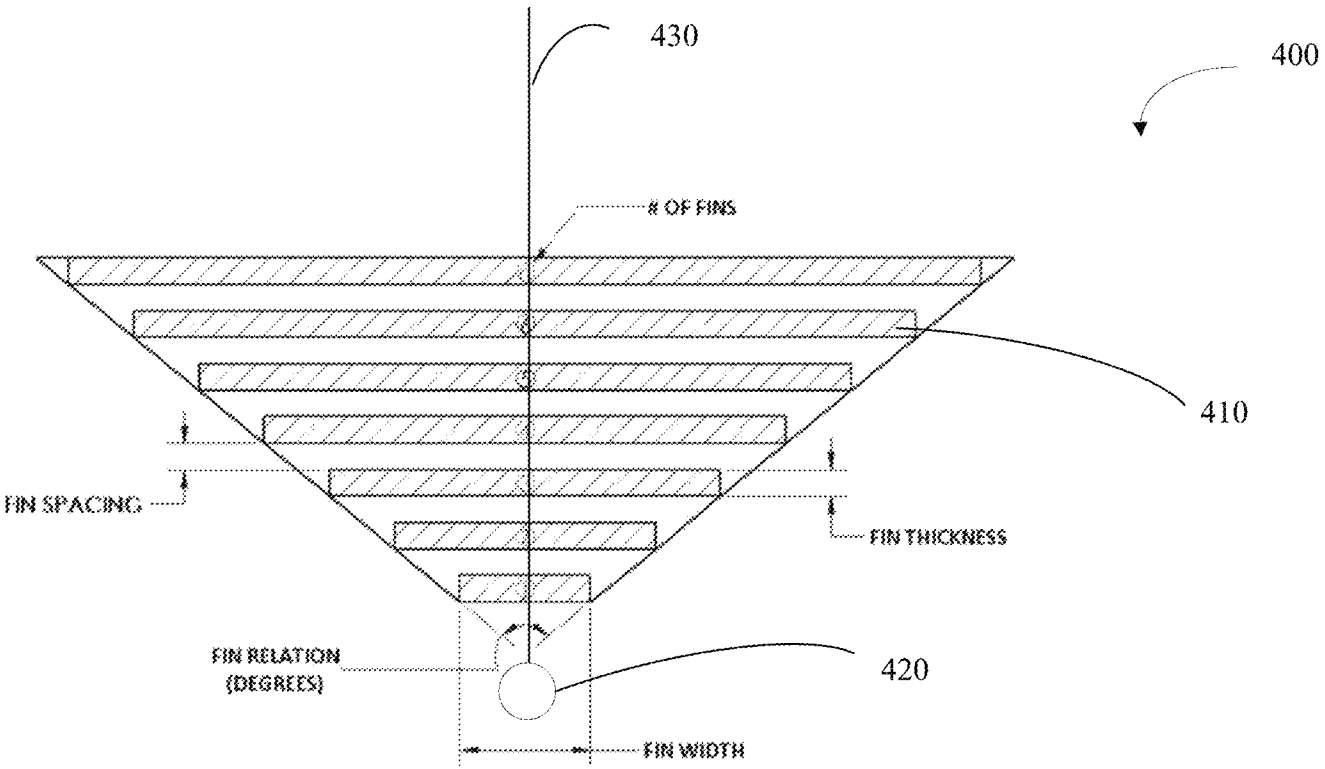
FIG. 4 is an example acoustic metamaterial fin structure having a fin geometry perpendicular to a sound source in accordance with certain implementations.

FIG. 4 is an example acoustic metamaterial fin structure 400 having a fin geometry perpendicular to a sound source 420 in accordance with certain implementations. The acoustic metamaterial fin structure 400 includes a plurality of fins 410 which are oriented perpendicular to the sound source 420. In an implementation, the fins 410 are made from very dense material, including but not limited to, brass which facilitates the structure's anisotropic properties by manipulating the bulk modulus and/or mass density in different directions through the structure, for example. The fin spacing, fin width, fin thickness, and number of fins 410 may be depend on the frequency of interest, wavelength of interest, application, environment, and the like. As a result, the fin relation may vary. In an implementation, the fin relation may cover an angle of up to 65°. Each of fins 410 has an identical or substantially identical fin thickness. In an implementation, the fin thickness may be between 5-15 mm. The spatial separation between each of the fins 410 is the same or substantially the same. In an implementation, the spatial separation may be between 5-15 mm. The fin width of each of the fins 410 is wider (in the perpendicular direction with respect to the single sound source 420) the further the fin 410 is from the sound source 420 and each fin 410 is symmetric about a line 430 drawn from the sound source 420. In an implementation, the fin width may be 19.05-24.5 mm and each subsequent fin width may be defined in accordance with the fin relation.

Figure 5:
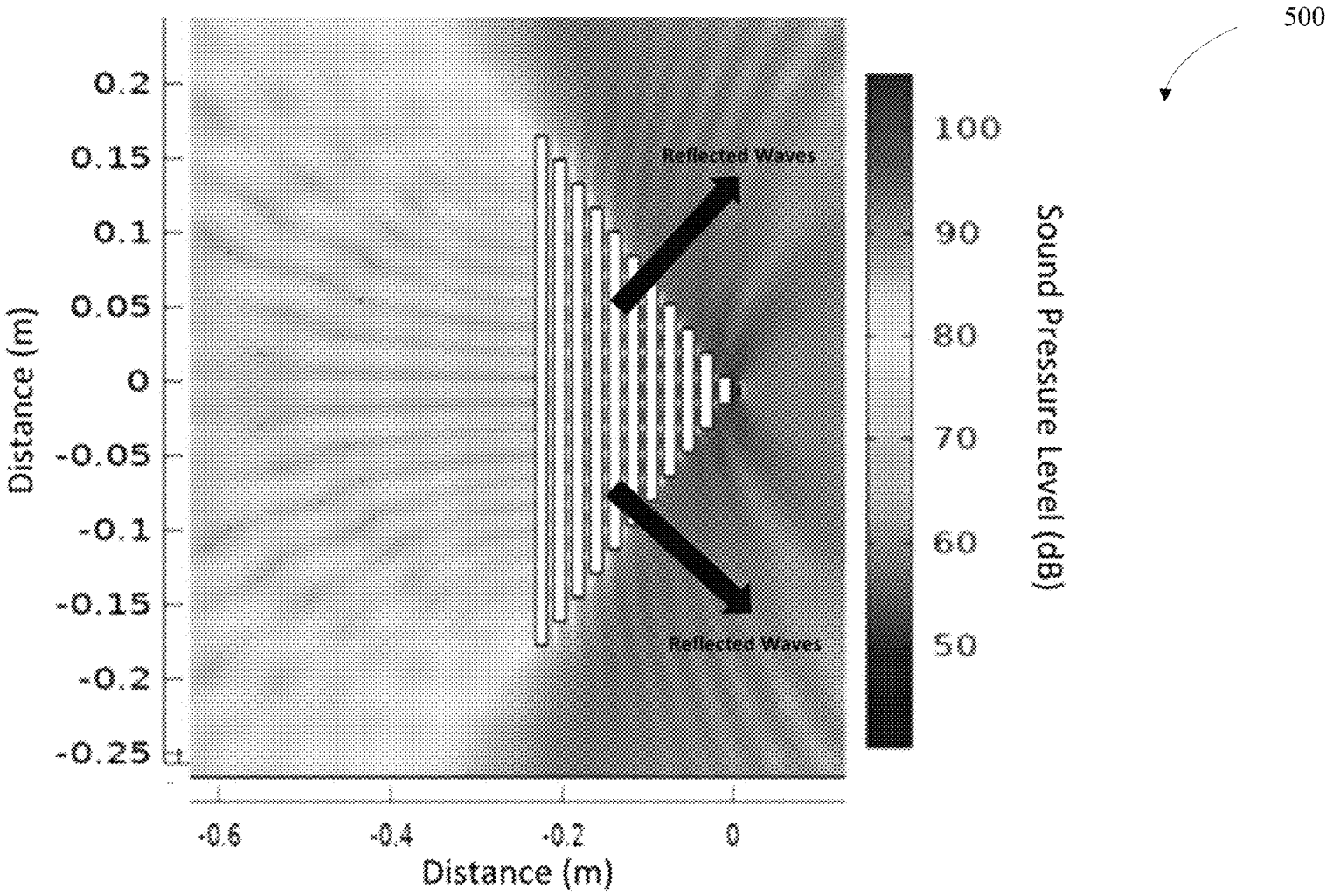
FIG. 5 is a simulated sound field or pattern of an example acoustic metamaterial fin structure having a fin geometry perpendicular to a sound source in accordance with certain implementations.
Figure 6:
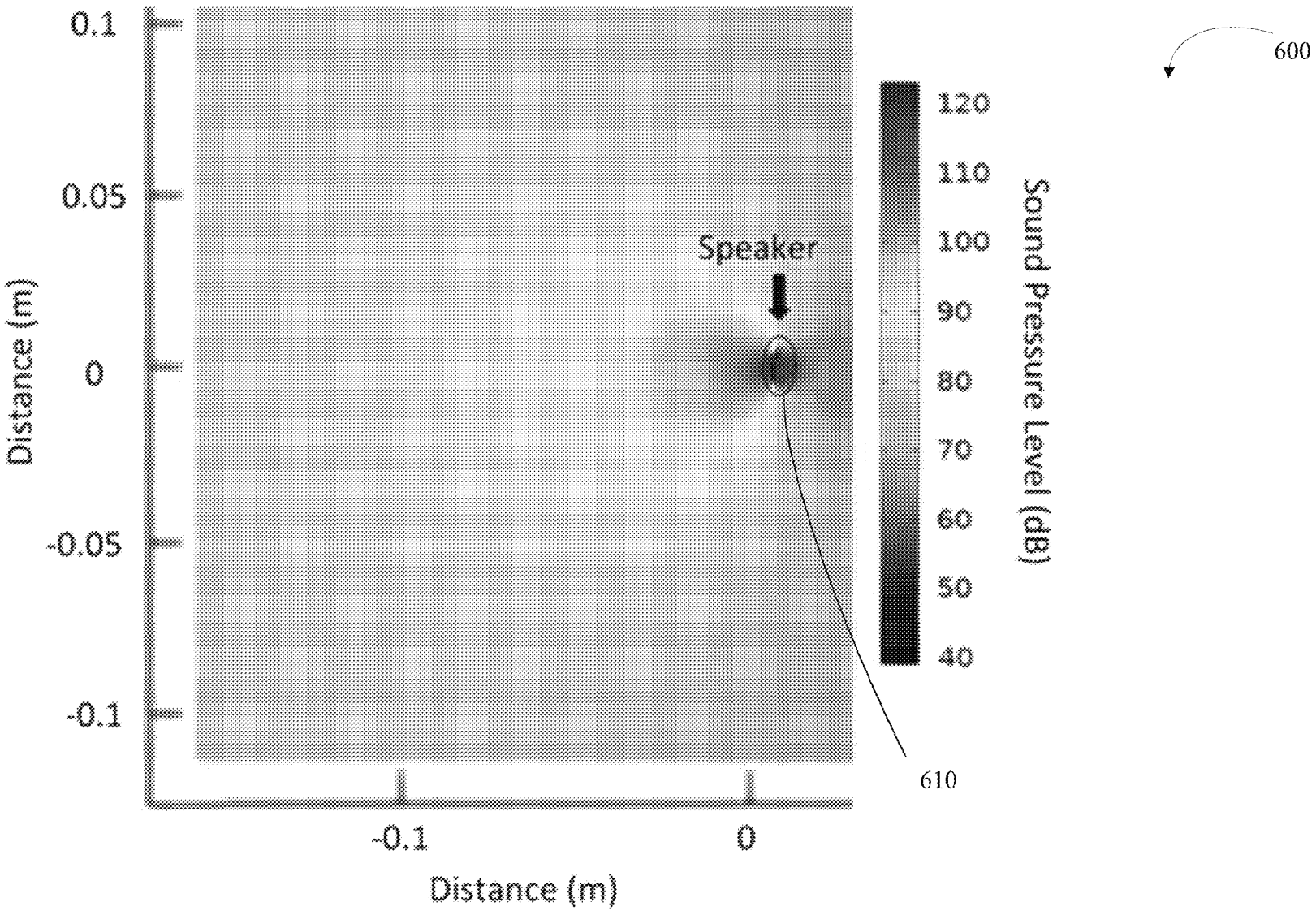
FIG. 6 is a simulated sound field or pattern of a standalone speaker.

FIG. 5 is a simulated sound field or pattern of an example acoustic metamaterial fin structure having a fin geometry perpendicular to a sound source in accordance with certain implementations. Amplitude enhancement is observed of the original sound source through redirection of the sound wave propagation. In an implementation, sound wave signal to noise ratio may improve through redirection of the sound waves back to a transducer via a metamaterial. FIG. 6 is a simulated sound field or pattern 600 of a standalone speaker 610. The simulated sound field or pattern 500 may be compared to the sound field or pattern 600 of the standalone speaker 610. As seen, the sound pressure levels are enhanced in the reflected waves in simulated sound field or pattern 500.

Figure 7:
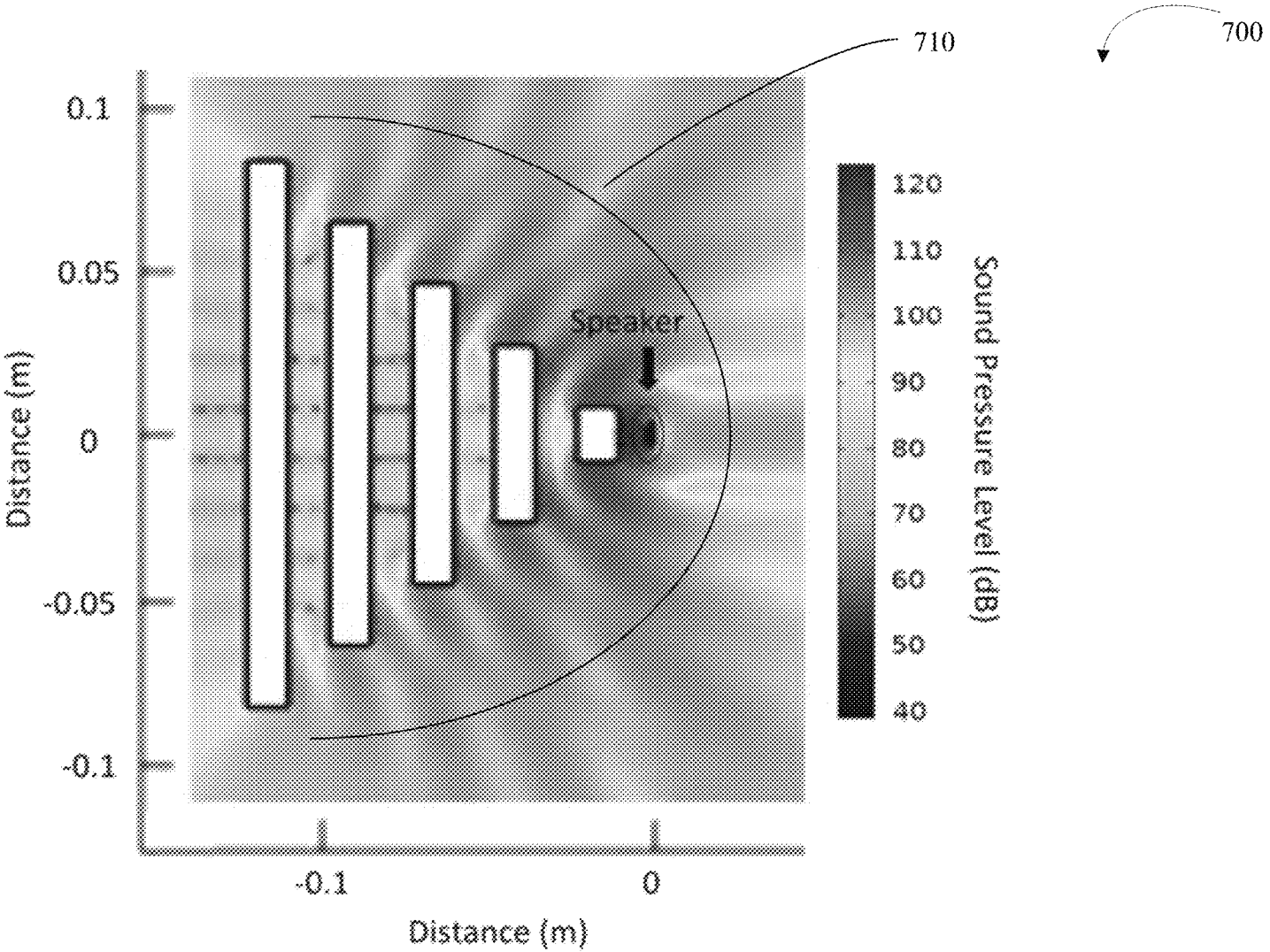
FIG. 7 is a simulated sound field or pattern of an example acoustic metamaterial fin structure having a fin geometry perpendicular to a sound source in accordance with certain implementations.
Figure 8:
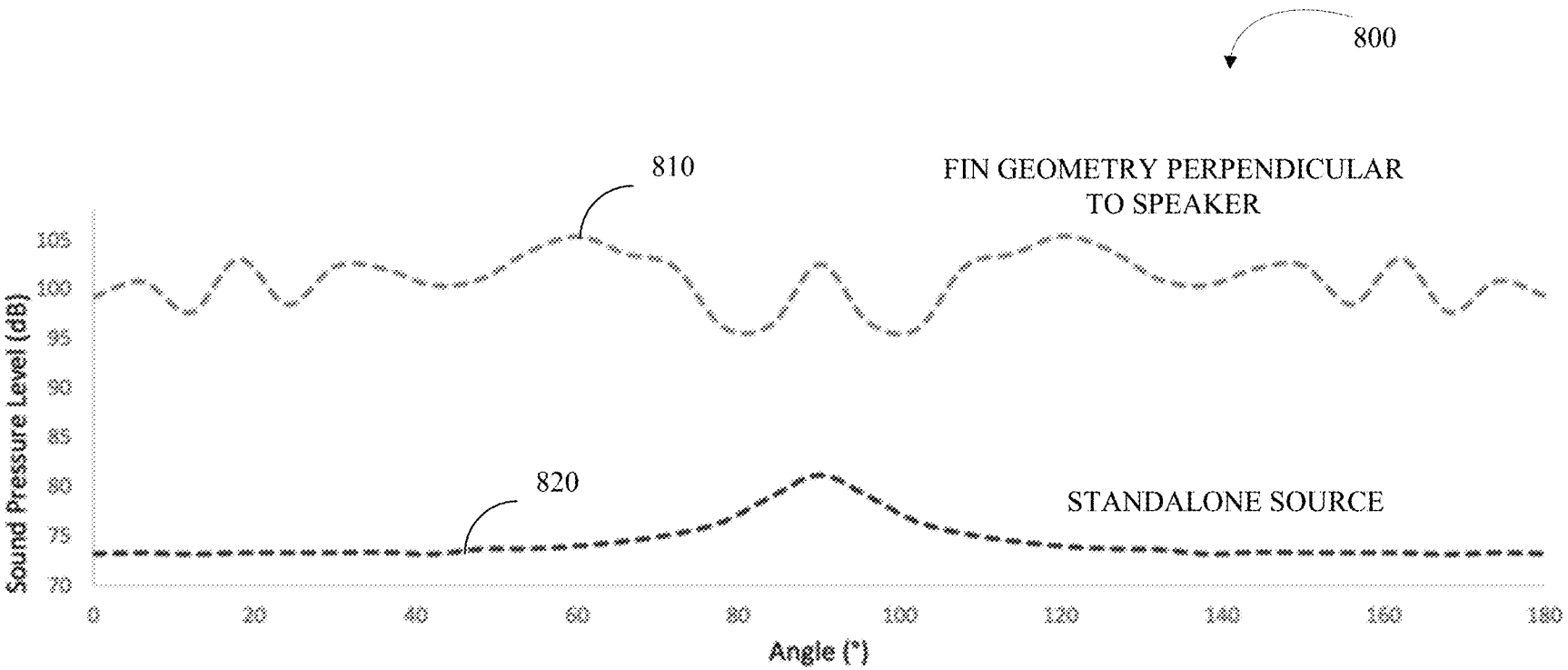
FIG. 8 is a simulated sound pressure diagram of an acoustic metamaterial fin structure having a fin geometry perpendicular to a sound source as shown in FIG. 7 versus a speaker standalone in accordance with certain implementations.
Figure 9:
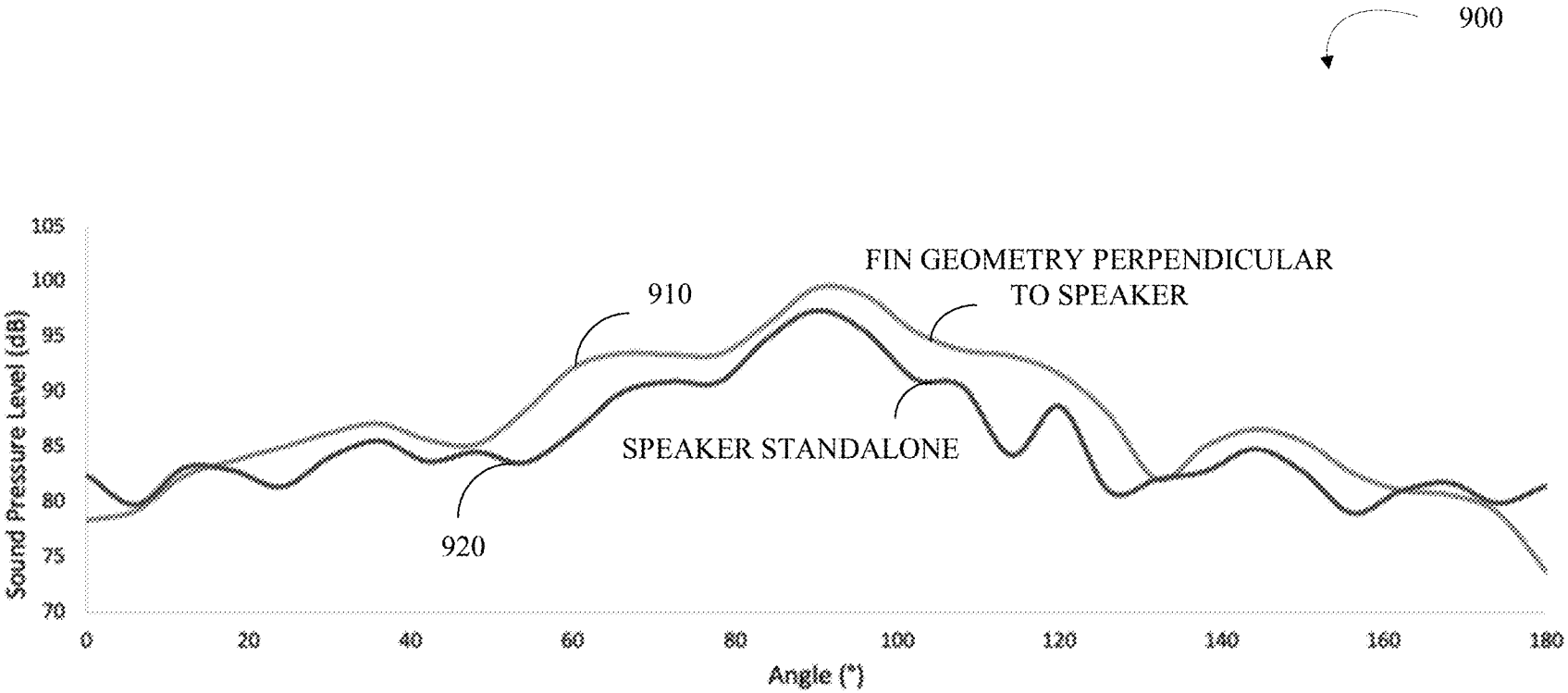
FIG. 9 is a measured sound pressure diagram of an acoustic metamaterial fin structure having a fin geometry perpendicular to a sound source as shown in FIG. 7 versus a speaker standalone in accordance with certain implementations.

FIG. 7 shows a sound field or pattern 700 of an example acoustic metamaterial fin structure having a fin geometry perpendicular to a sound source in accordance with certain implementations. An amplitude enhancement is observed of the original sound source through redirection of the sound wave propagation. FIG. 8 is a simulated sound pressure diagram 800 of an acoustic metamaterial fin structure having a fin geometry perpendicular to a sound source versus a speaker standalone in accordance with certain implementations. In particular, along a cut arc 710 shown in FIG. 7, there is an enhanced sound pressure level 810 for the acoustic metamaterial fin structure having a fin geometry perpendicular to the sound source versus a sound pressure level 820 of a standalone sound source. The simulated enhanced sound pressure level is approximately 25 dB higher in contrast to the standalone sound source along the cut arc 710. FIG. 9 is a measured sound pressure diagram 900 of an acoustic metamaterial fin structure having a fin geometry perpendicular to a sound source versus a speaker standalone in accordance with certain implementations. A measured enhanced sound pressure level 910 is generally higher than a sound pressure level 920 of the standalone sound source along the cut arc 710 of FIG. 7. As shown, the perpendicular fin orientation enhances and redirects the sound waves.

In an implementation, the acoustic metamaterial fin structure and perpendicular geometric fin configuration shown and described in FIGS. 3-9 may be used in a self-contained noise cancelling metamaterial structure. The self-contained noise cancelling metamaterial structure may reduce the unwanted noise emitted from various devices such as pumps, fans, motors, actuators, and the like found in equipment used in the medical, commercial and manufacturing industries. The self-contained noise cancelling metamaterial structure may reduce unwanted noise emissions from any internal source located inside the metamaterial structure by using less space, less material and additive manufacturing techniques. Moreover, the self-contained noise cancelling metamaterial structure may be used with any product that exhibits noise levels considered to be detrimental towards the end user. This includes both OSHA safe exposure levels and annoyance levels. Noise reduction may also be utilized in a manufacturing environment to improve processes and working conditions. The described metamaterial structure requires significantly less material to provide an equivalent reduction in performance over traditional methods.

In an implementation, the self-contained noise cancelling metamaterial structure may provide air circulation between and around the fins. This allows the sound source to be air cooled by air flowing through the metamaterial structure.

Known existing noise reduction solutions require the use of traditional sound deadening materials such as cellular foam, mass loaded vinyl, sealants and thermoplastic composites. These solutions require large volumes of materials which take up valuable space in the application environment. The large amount of material usage is also very costly. Traditional methods require large volumes of sound blocking and/or sound absorbing materials that are costly and take up valuable real estate. There are also limitations on performance effectiveness when using traditional materials.

Figure 10:
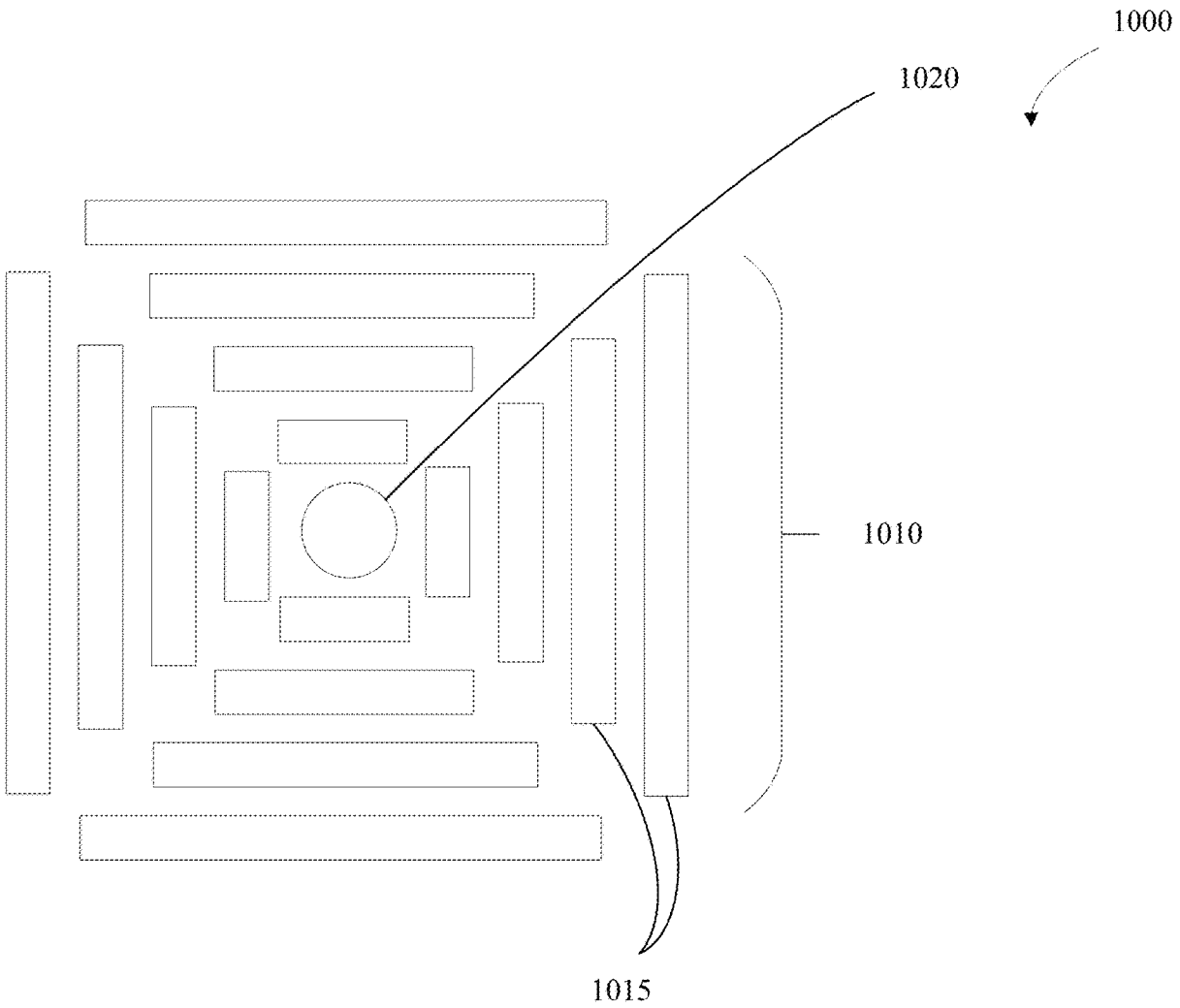
FIG. 10 is an example 2D acoustic metamaterial structure for sound cancellation in accordance with certain implementations.
Figure 11:
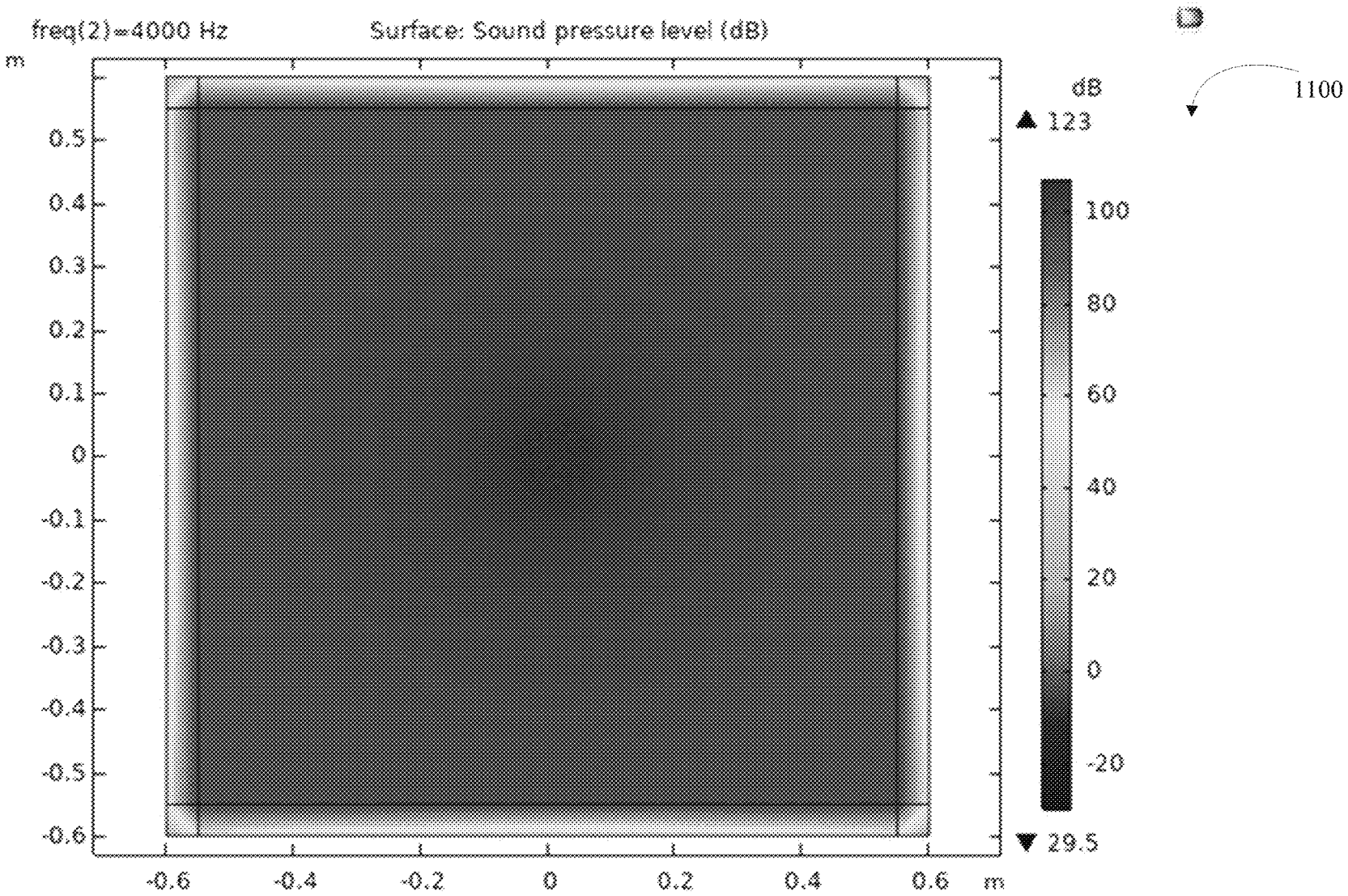
FIG. 11 is a simulated 2D sound field or pattern for a reference monopole point source.
Figure 12:
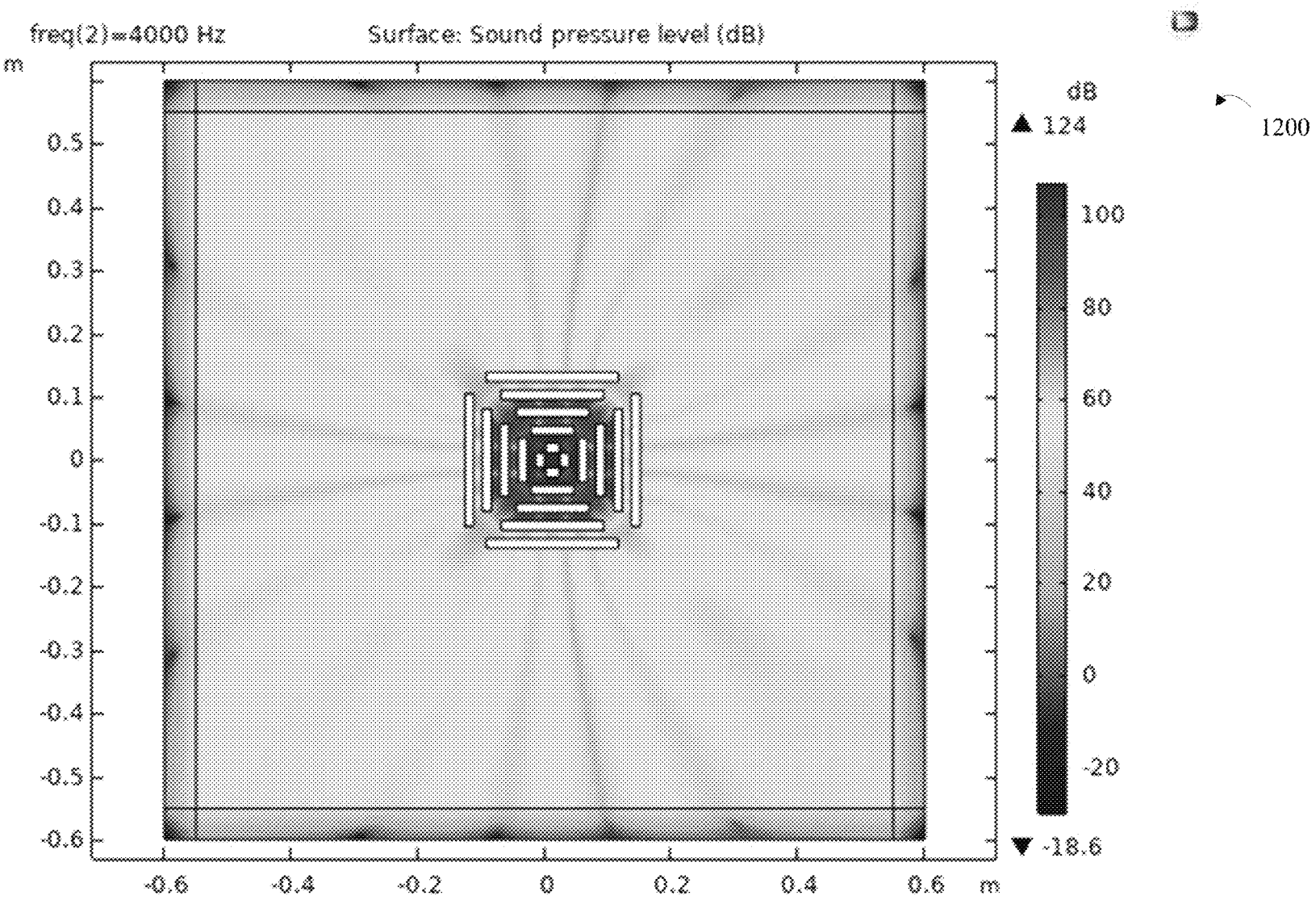
FIG. 12 is a simulated 2D sound field or pattern for an example acoustic metamaterial fin structure (as shown in FIG. 10) for sound cancellation in accordance with certain implementations.

FIG. 10 is a 2D diagram of an example acoustic metamaterial fin structure 1000 for noise cancellation in accordance with certain implementations. The acoustic metamaterial structure 1000 includes a plurality of metamaterial fin sections 1010 which enclose a sound source 1020, where each metamaterial fin section 1010 may have the properties and geometric configuration described herein with respect to FIGS. 3-9. In an implementation, the metamaterial fin sections 1010 can be substantially identical. For example, each metamaterial fin section 1010 includes a number of fins 1015 separated by air layers, where the fin spacing, find width, fin thickness, and number of fins depends on the characteristics of the sound source 1020, desired level of cancellation, and like characteristics and/or requirements. In the geometric configuration shown in FIG. 10, 4 of the metamaterial fin sections 1010 surround or enclose, or substantially surround or enclose the sound source 1020. FIG. 11 is a simulated 2D sound field or pattern 1100 for a reference monopole point source. A uniform sound pressure level distribution for a 4 kHz sound source is shown. As shown, the sound pressure level (SPL) is approximately 100 dB at 0.5 meters in all directions. FIG. 12 is a simulated 2D sound field or pattern 1200 for an example acoustic metamaterial fin structure (such as the acoustic metamaterial fin structure 1000 of FIG. 10) for sound cancellation in accordance with certain implementations. The sound field or pattern 1200 is with respect to a 4 kHz sound source. As shown, the acoustic metamaterial fin structure 1000 reduces the sound pressure level to approximately 55 dB in all directions.

Figure 13:
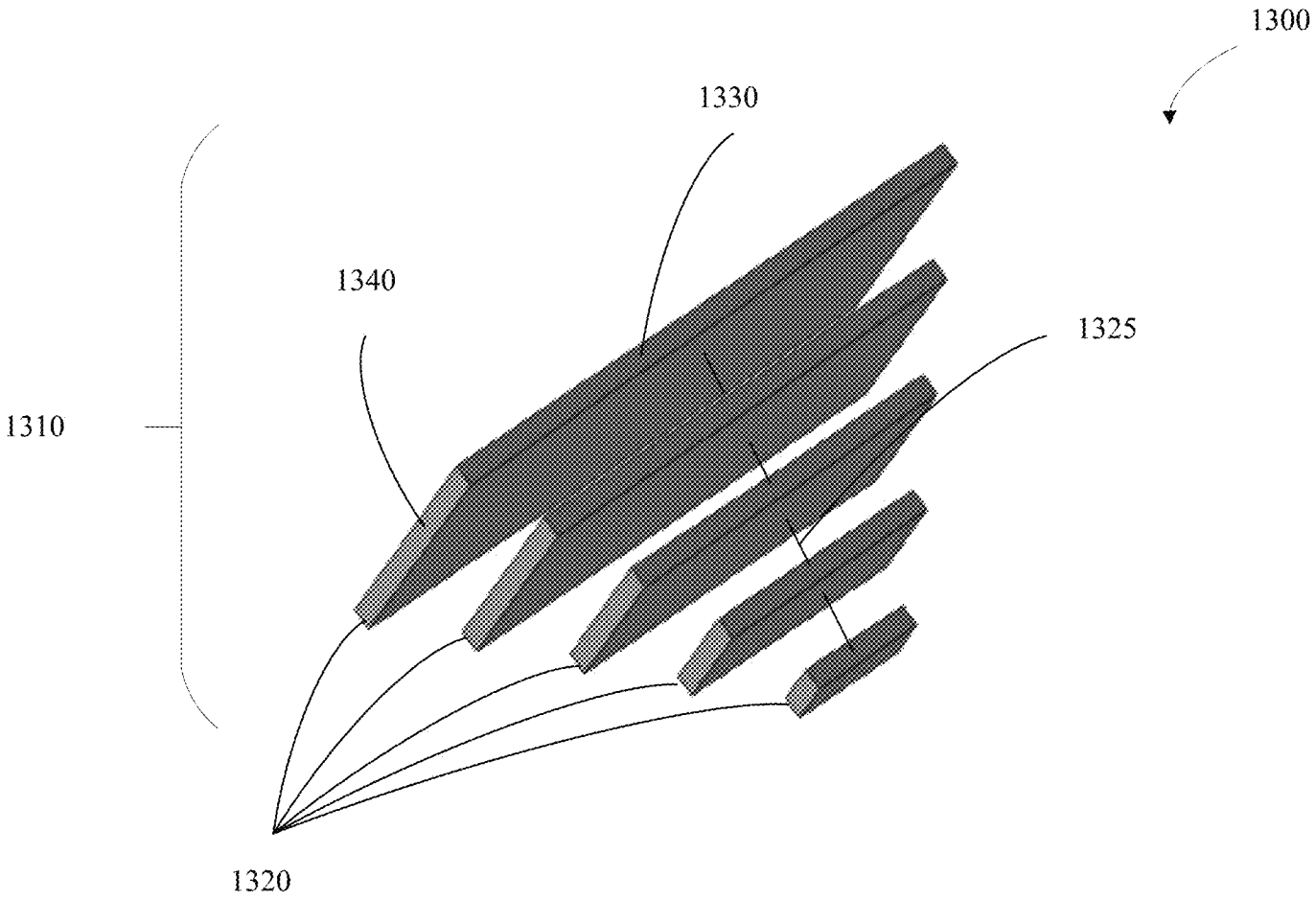
FIG. 13 is a perspective view of one metamaterial fin section of an example 3D acoustic metamaterial fin structure for sound cancellation in accordance with certain implementations.
Figure 14:
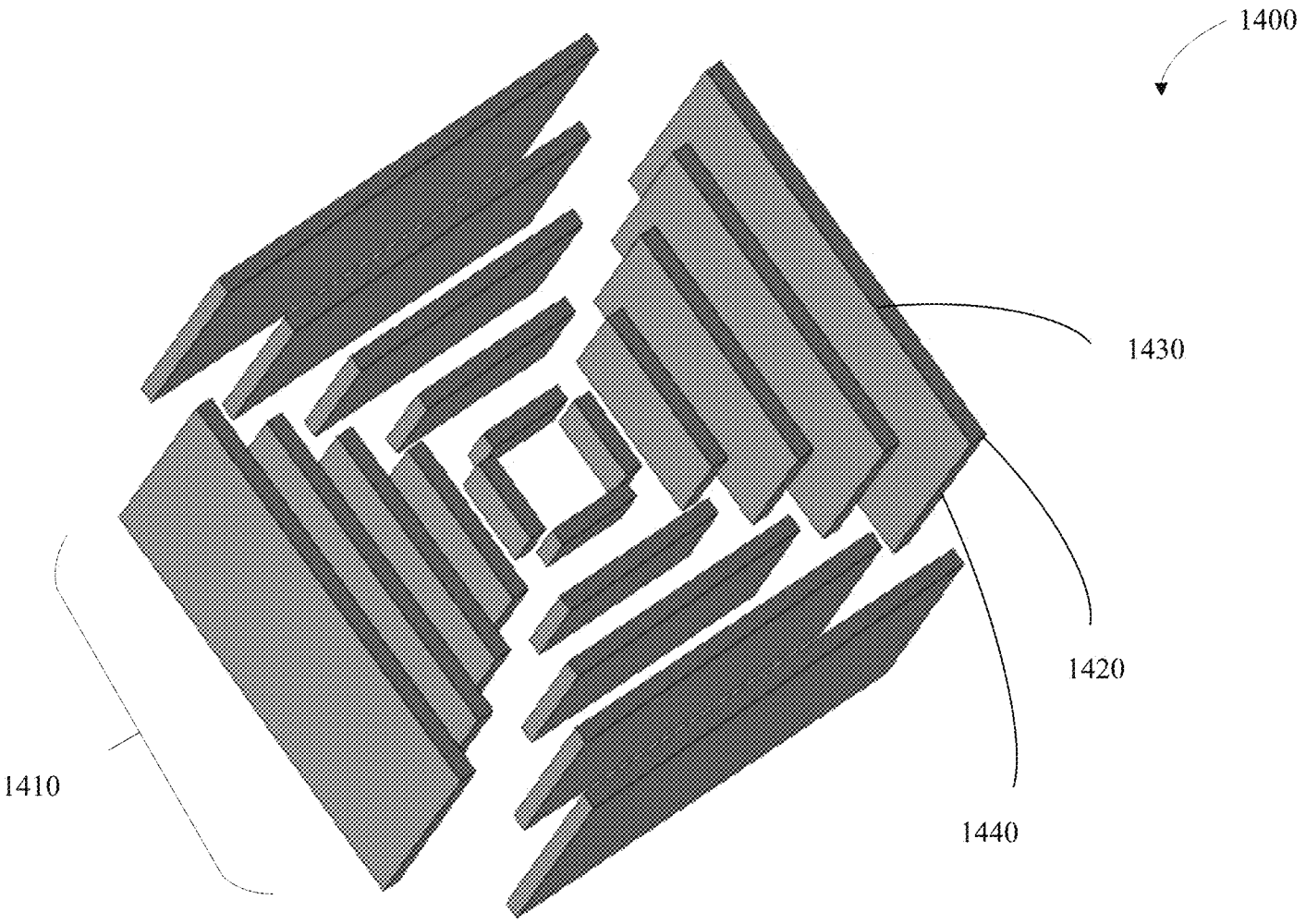
FIG. 14 is a perspective view of four metamaterial fin sections of an example 3D acoustic metamaterial fin structure for sound cancellation in accordance with certain implementations.
Figure 15:
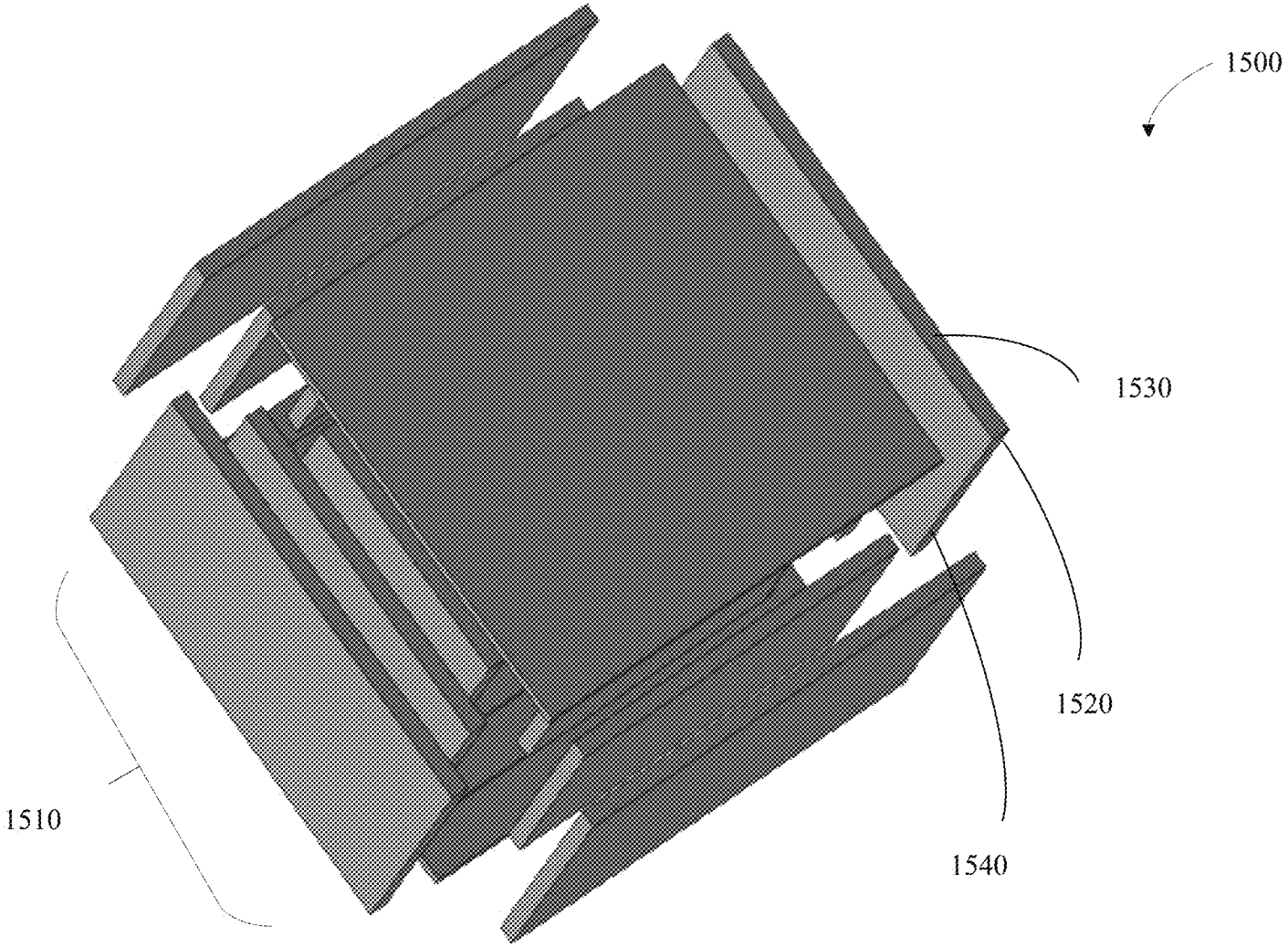
FIG. 15 is a perspective view of six metamaterial fin sections of an example 3D acoustic metamaterial fin structure for sound cancellation in accordance with certain implementations.

FIG. 13 is a perspective view 1300 of one metamaterial fin section 1310 of an example 3D acoustic metamaterial fin structure, as shown for example in FIG. 14 or FIG. 15, for sound cancellation in accordance with certain implementations. The metamaterial fin section 1310 has a fin spacing, fin width (or length), fin thickness, and number of fins which depends on the characteristics and geometry of the sound source, desired level of cancellation, and like characteristics and/or requirements. In an implementation, the metamaterial fin sections 1310 can be substantially identical. In an implementation, a width 1330 and a length 1340 of each fin 1320 have the same value. In an implementation, the fins 1320 are connected to each other by a center beam 1325. In an implementation, the fins 1320 are connected to each other by a skeletal support structure. In an implementation, noise dampening materials such as foam may be used for interconnection the fins 1320. The air space between the fins and the fin sections could be filled with foam which connects the fins and fin sections together. In addition, the foam can provide sound absorbing performance for a wider frequency spectrum where the fin sections can be focused on a resonant frequency of higher amplitudes. Other connection techniques may be used without departing from the scope of the specification and claims.

FIG. 14 is a perspective view 1400 of four metamaterial fin sections 1410 of an example 3D acoustic metamaterial fin structure, as shown for example in FIG. 14 or FIG. 15, for sound cancellation in accordance with certain implementations. Each metamaterial fin section 1410 has a fin spacing, find width (or length), fin thickness, and a number of fins which depend on the characteristics and/or geometry of the sound source, desired level of cancellation, and like characteristics and/or requirements. In an implementation, the metamaterial fin sections 1410 can be substantially identical. In an implementation, a width 1430 and a length 1440 of each fin 1420 have the same value. Although not shown, the interconnections can be implemented as described herein for FIG. 13.

FIG. 15 is a perspective view of six metamaterial fin sections 1510 of an example 3D acoustic metamaterial fin structure 1500 for sound cancellation in accordance with certain implementations. Each fin metamaterial section 1510 has a fin spacing, fin width (or length), fin thickness, and number of fins which depend on the characteristics and/or geometry of the sound source, desired level of cancellation, and like characteristics and/or requirements. In an implementation, the metamaterial fin sections 1510 can be substantially identical. In an implementation, a width 1530 and a length 1540 of each fin 1520 have the same value. Although not shown, the interconnections can be implemented as described herein for FIG. 13.

Figure 16:
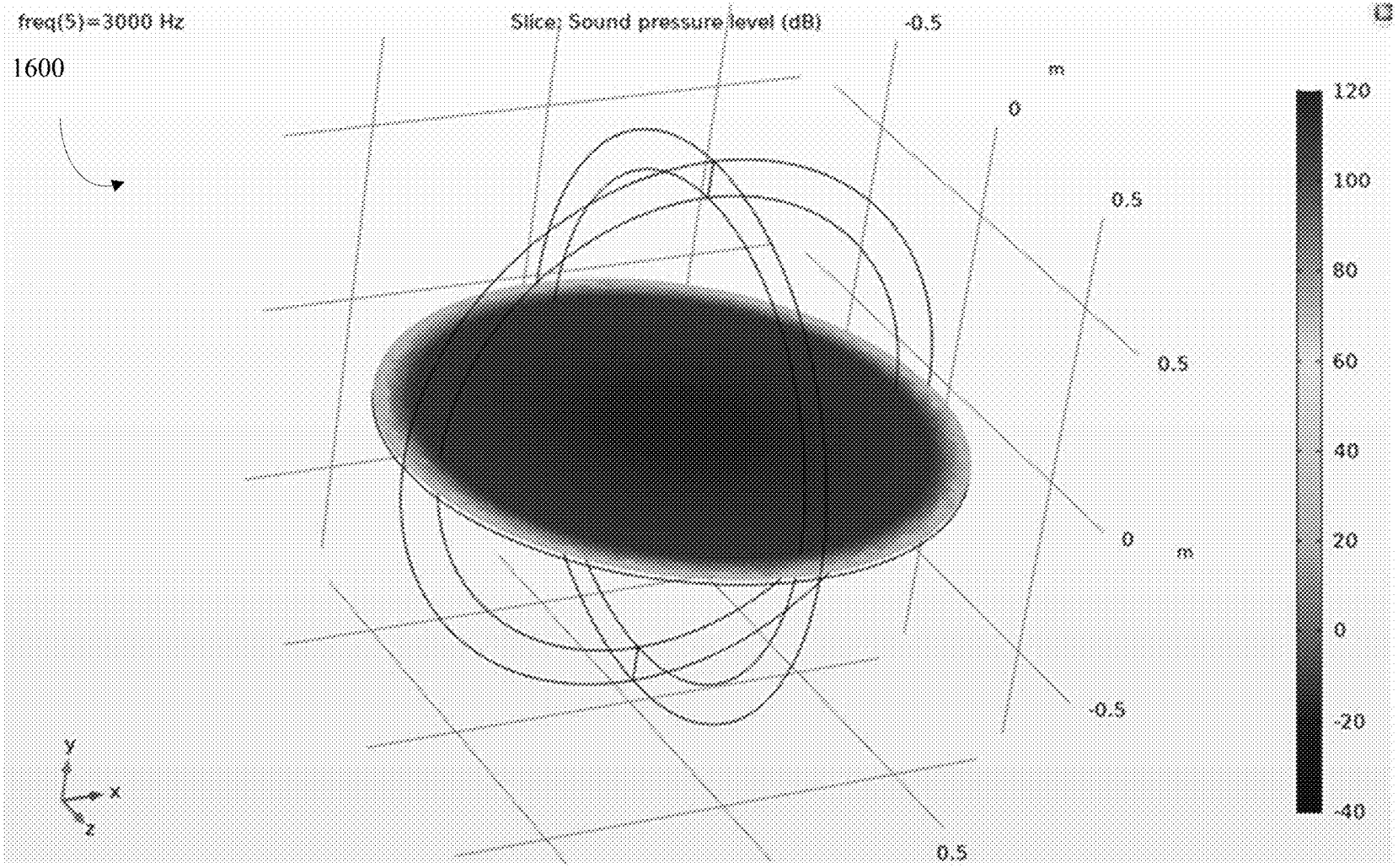
FIG. 16 is a simulated sound field or pattern shown in a cross-sectional view of a 3D reference monopole source.
Figure 17:
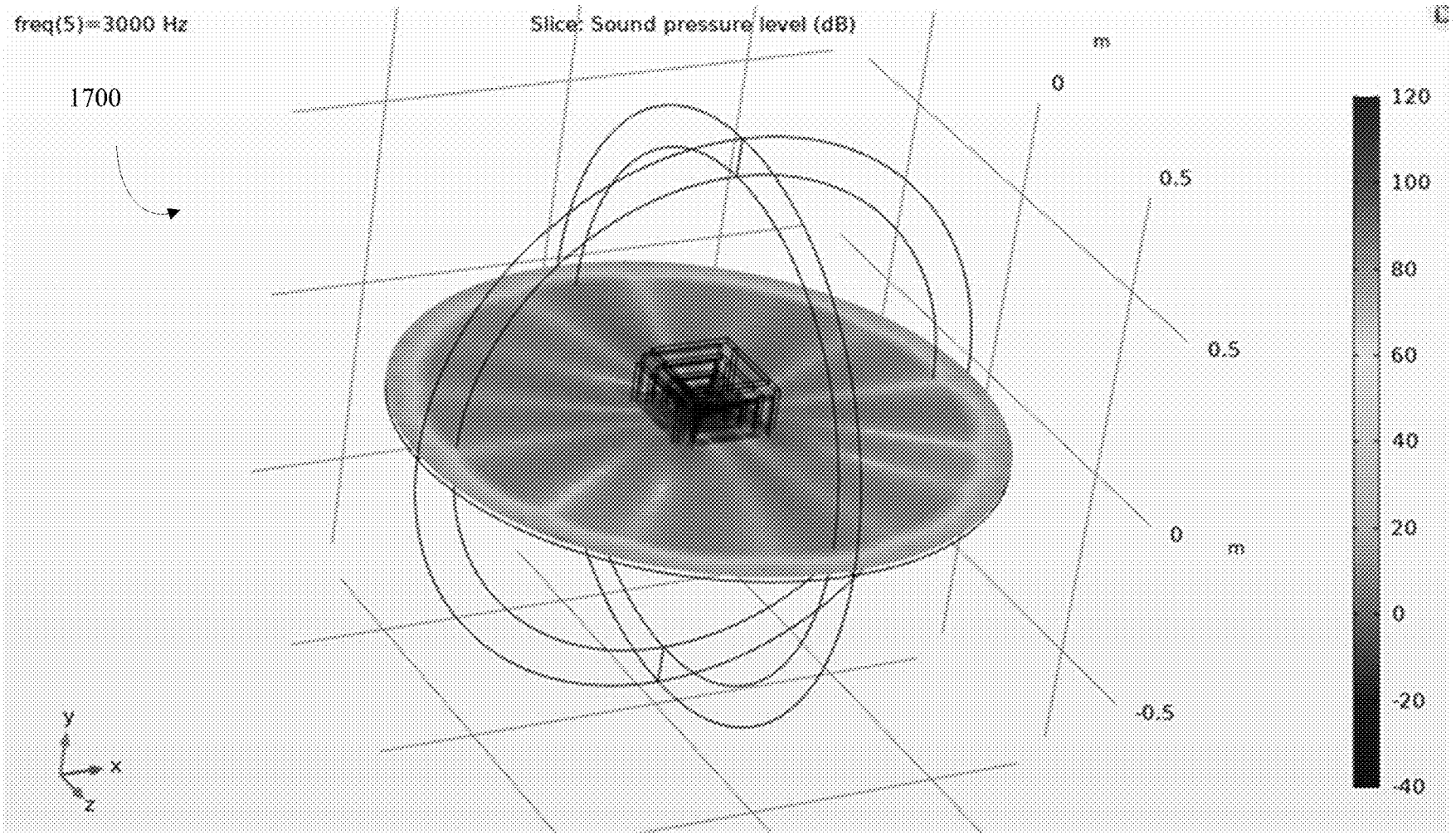
FIG. 17 is a simulated sound field or pattern shown in a cross-sectional view of a 3D acoustic metamaterial structure for sound cancellation in accordance with certain implementations.

FIG. 16 is a simulated sound field or pattern shown 1600 in a cross-sectional view of a 3D reference monopole source. As shown, the sound pressure level is substantially uniform at or near approximately 100-120 dB. FIG. 17 is a simulated sound field or pattern 1700 shown in a cross-sectional view of a 3D acoustic metamaterial structure, for example the 3D acoustic metamaterial structure of FIG. 15, for sound cancellation in accordance with certain implementations. As shown, the sound pressure level decrease is uniform at approximately 80 dB.

Operationally, a set of the metamaterial fin sections are arranged to substantially enclose a sound source. In an implementation, the metamaterial fin sections are symmetrically arranged around the sound source. Sound emanating from the sound source encounters the metamaterial fin sections. Each of the metamaterial fin sections reflect back the sound due to symmetry of the metamaterial fin sections and orientation. As a result, the reflections cancel out and noise cancellation occurs.

Figure 18:
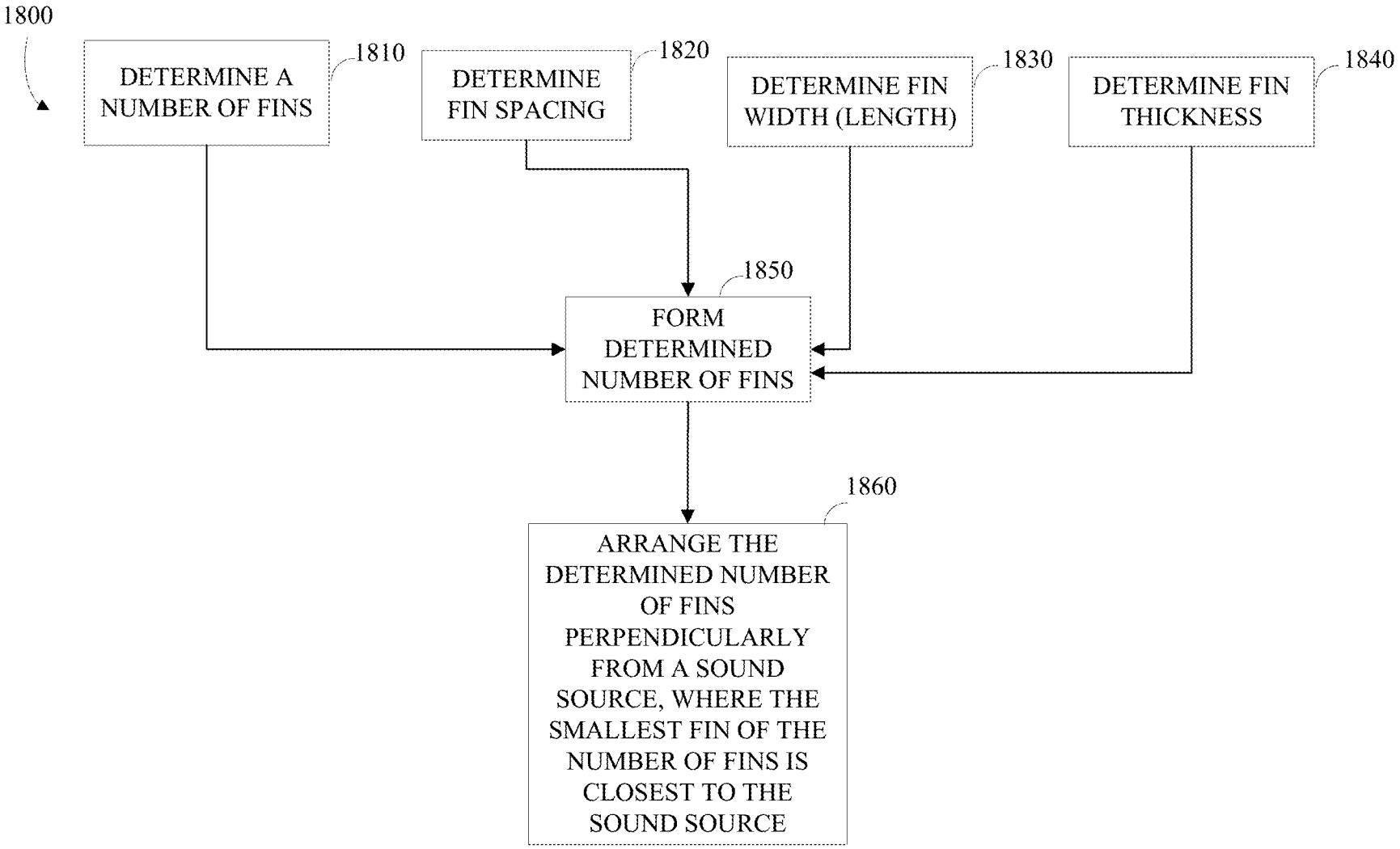
FIG. 18 is an example of a flowchart of a method for providing an acoustic metamaterial fin section in accordance with certain implementations.

FIG. 18 is a flowchart of an example method 1800 for providing an acoustic metamaterial fin section in accordance with certain implementations. The method includes: determining 1810 a number of fins of varying sizes made from very dense materials with respect to the density of air; determining 1820 fin spacing; determining 1830 fin width (or length); determining 1840 fin thickness; forming 1850 the determined number of fins; and arranging 1860 the number of fins perpendicularly from a sound source, where the fin with the smallest width (or length) is located closest to the sound source.

The method 1800 includes determining 1810 a number of fins of varying sizes made from very dense materials with respect to the density of air, determining 1820 fin spacing, determining 1830 fin width (or length), and determining 1840 fin thickness. Each fin is wider and longer in the perpendicular direction with respect to a sound source. The size and number of fins may depend on the frequency of interest, wavelength of interest, sound source characteristics, and the like. In an implementation, the acoustic metamaterial is brass which has had its anisotropic properties manipulated by varying bulk modulus and/or mass density.

The method 1800 includes forming 1850 the determined number of fins. Each fin is formed using the fin width (or length) and fin thickness.

The method 1800 includes arranging 1860 the determined number of fins perpendicularly from a sound source, where the smallest fin of the number of fins is closest to the sound source. Each fin is positioned symmetrically about a line drawn from the sound source. Sound emanating from the sound source is amplified and reflected back toward the sound source. In an implementation, amplification is due to additive properties of multiple in phase redirections of the sound waves via each of the fins.

Figure 19:
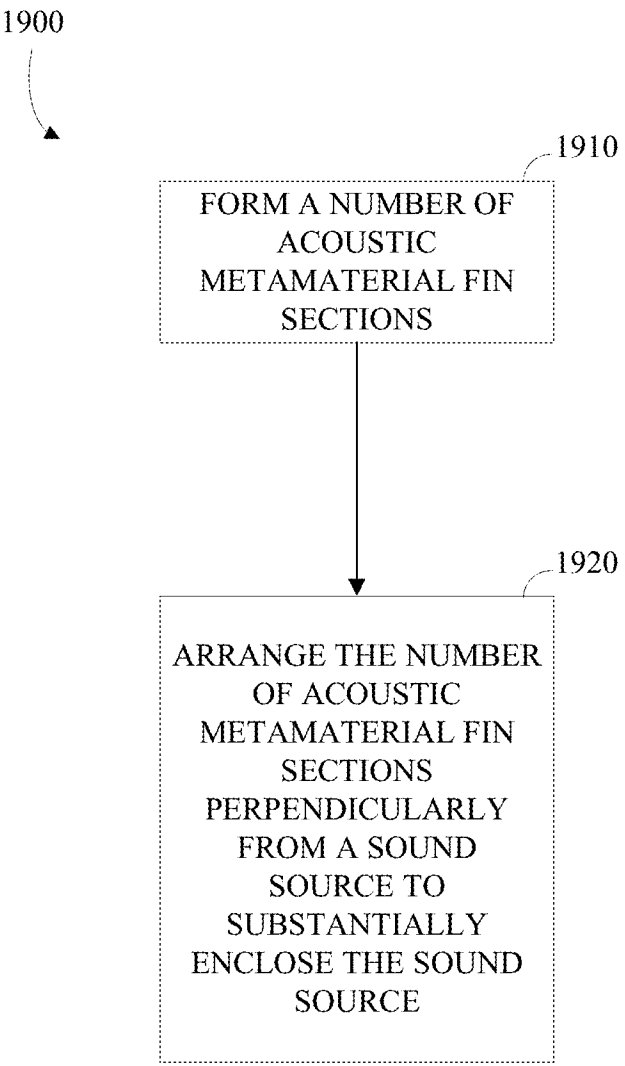
FIG. 19 is an example of a flowchart of a method for providing an acoustic metamaterial fin structure consisting of a defined number of metamaterial fin sections in accordance with certain implementations.

FIG. 19 is a flowchart an example method 1900 for providing an acoustic metamaterial fin structure consisting of a defined number of metamaterial fin sections in accordance with certain implementations. The method includes: forming 1910 a number of acoustic metamaterial fin sections; and arranging 1920 the number of acoustic metamaterial fin sections perpendicularly from a sound source to substantially enclose the sound source. The example method 1900, for example, provides a self-contained noise cancellation metamaterial structure using fin sections with fins made from very dense material with respect to the density of air.

The method 1900 includes providing 1910 a number of acoustic metamaterial fin sections. The acoustic metamaterial fin sections are substantially identical or identical in size and consisting of fins made from very dense materials with respect to the density of air where each fin is wider (or longer) in the perpendicular direction away from a sound source. The number of acoustic metamaterial fin sections may depend on the frequency of interest, wavelength of interest, sound source characteristics, sound cancellation characteristics, and the like. In an implementation, the fin material is brass which manipulates the anisotropic properties of the metamaterial fin sections by varying bulk modulus and/or mass density in different directions through the pyramid shaped fin sections. In an implementation, each fin section represents a pyramidal structure. In an implementation, the acoustic metamaterial fin sections use method 1800 of FIG. 18.

The method 1900 includes arranging 1920 the number of acoustic metamaterial fin sections perpendicularly from a sound source to substantially enclose the sound source such that the smallest fin in the acoustic metamaterial fin section is closest to the sound source. In an implementation, an acoustic metamaterial fin section is positioned symmetrically about a line drawn perpendicular from the sound source. Sound emanating from the sound source is cancelled due to destructive interference of the reflected sound waves located between each acoustic metamaterial fin section in the metamaterial structure.

The construction and arrangement of the methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials and components, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An acoustic metamaterial device for using with a sound source, comprising:

a plurality of fins, wherein each fin is made from a very dense material with respect to air which creates the anisotropic properties of the acoustic metamaterial device, wherein each fin has a length dimension, a width dimension, and a thickness dimension, the width and length dimension being equal and substantially perpendicular to the direction of sound wave propagation from the sound source, wherein each fin is sized different from other fins along the width and length dimension, and wherein the plurality of fins are interconnected such that planes formed by the width and length dimension of each fin faces perpendicular to the sound wave propagation direction from the sound source.

2. The acoustic metamaterial device of claim 1, wherein the thickness dimension for each of the plurality of fins is the same.

3. The acoustic metamaterial device of claim 1, wherein the fin width and the fin length depend on at least one of frequency of interest, wavelength of interest, desired amplification, desired directivity and size and characteristics of the sound source.

4. The acoustic metamaterial device of claim 3, wherein the fin thickness depends on at least one of frequency of interest, wavelength of interest, desired amplification, desired directivity and size and characteristics of the sound source.

5. The acoustic metamaterial device of claim 4, wherein a fin spacing depends on at least one of frequency of interest, wavelength of interest, desired amplification, desired directivity and size and characteristics of the sound source.

6. The acoustic metamaterial device of claim 5, wherein the number of fins depends on at least one of frequency of interest, wavelength of interest, desired amplification, desired directivity and size and characteristics of the sound source.

7. The acoustic metamaterial device of claim 1, further comprising:

a plurality of fin sections, each fin section including a set of the plurality of fins, wherein the plurality of fin sections substantially enclose the sound source.

8. The acoustic metamaterial device of claim 7, wherein an apex of each of the plurality of fin sections is closest to the sound source.

9. A noise cancellation device, comprising:

a plurality of fin sections, each fin section including:

a plurality of fins, wherein each fin is made from a very dense material with respect to air which creates the anisotropic properties of the acoustic metamaterial device, wherein each fin has a first dimension, a second dimension, and a third dimension, wherein two of the first dimension, second dimension, and the third dimension being equal and substantially perpendicular to a sound wave propagation direction from a sound source, wherein each fin is sized different along the two equal dimensions, wherein the plurality of fins are interconnected such that planes formed by the equal two dimensions of each fin is perpendicular to the sound wave propagation direction from the sound source, and wherein the plurality of fin sections substantially enclose the sound source.

10. The noise cancellation device of claim 9, wherein the two equal dimensions depend on at least one of frequency of interest, wavelength of interest, desired amplification, desired directivity and size and characteristics of the sound source.

11. The noise cancellation device of claim 10, wherein the number of fin sections depends on at least one of frequency of interest, wavelength of interest, desired amplification, desired directivity and size and characteristics of the sound source.

12. The noise cancellation device of claim 11, wherein a fin spacing depends on at least one of frequency of interest, wavelength of interest, desired amplification, desired directivity and size and characteristics of the sound source.

13. A method for making an acoustic metamaterial device, the method comprising:

forming a plurality of fins from a very dense material with respect to the density of air which defines the anisotropic properties of the device, wherein each fin has a different volume defined by a length dimension, a width dimension and a thickness dimension, wherein each fin is sized different from other fins along the width dimension and the length dimension, and wherein the plurality of fins are interconnected such that the planes formed by the length dimension and the width dimensions of each fin are substantially parallel; and arranging the plurality of fins such that the planes formed by the length dimension and the width dimensions of each fin are perpendicular to the direction of sound wave propagation from a sound source.

14. The method of claim 13, wherein the fin with the smallest volume is closest to the sound source.

15. The method of claim 13, wherein the length dimension and the width dimension for a specific fin is same.

16. The method of claim 13, wherein the number of fins depends on at least one of frequency of interest, wavelength of interest, desired amplification, desired directivity and size and characteristics of the sound source.

17. The method of claim 16, wherein the length dimension and the width dimension depend on at least one of frequency of interest, wavelength of interest, desired amplification, desired directivity and size and characteristics of the sound source.

18. The method of claim 17, wherein a fin spacing depends on at least one of frequency of interest, wavelength of interest, desired amplification, desired directivity and size and characteristics of the sound source.

19. The method of claim 13, wherein the thickness dimension is the same for each of the plurality of fins.

20. The method of claim 13, further comprising:

forming a number of fin sections, each fin section including a set of the plurality of fins; and arranging the number of fin sections perpendicularly from the sound source to substantially enclose the sound source.

* * * * *